US008297993B2

(12) United States Patent
Schmidt

(10) Patent No.: US 8,297,993 B2
(45) Date of Patent: Oct. 30, 2012

(54) CONNECTOR ARRANGEMENT WITH MATE-ASSIST DEVICE

(75) Inventor: Rainer Schmidt, Nuremberg (DE)

(73) Assignee: FCI Automotive Holding, Guyancourt (FR)

( * ) Notice: Subject to any disclaimer, the term of this patent is extended or adjusted under 35 U.S.C. 154(b) by 0 days.

(21) Appl. No.: 13/138,056

(22) PCT Filed: Dec. 31, 2008

(86) PCT No.: PCT/IB2008/003835

§ 371 (c)(1), (2), (4) Date: Aug. 31, 2011

(87) PCT Pub. No.: WO2010/076592

PCT Pub. Date: Jul. 8, 2010

(65) Prior Publication Data

US 2011/0306230 A1 Dec. 15, 2011

(51) Int. Cl.
*H01R 13/62* (2006.01)

(52) U.S. Cl. ..... 439/157

(58) Field of Classification Search ..... 439/157, 439/347, 489, 752, 595, 701

See application file for complete search history.

(56) References Cited

U.S. PATENT DOCUMENTS

| | | | | |
|---|---|---|---|---|
| 6,244,880 | B1 * | 6/2001 | Fukase et al. | 439/157 |
| 6,382,992 | B1 * | 5/2002 | Bouchan et al. | 439/157 |
| 6,422,882 | B1 | 7/2002 | May et al. | 439/157 |
| 6,475,004 | B2 * | 11/2002 | Shuey et al. | 439/157 |
| 7,497,706 | B2 * | 3/2009 | Daudin et al. | 439/157 |
| 7,982,578 | B2 * | 7/2011 | Buettner | 337/196 |
| 8,197,270 | B2 * | 6/2012 | Vasbinder et al. | 439/157 |

FOREIGN PATENT DOCUMENTS

DE 198 02 554 A1 8/1999

* cited by examiner

*Primary Examiner* — Tulsidas C Patel
*Assistant Examiner* — Phuongchi Nguyen
(74) *Attorney, Agent, or Firm* — Harrington & Smith

(57) ABSTRACT

The present application relates to a connector arrangement, including a first connector housing and a complementary second connector housing and a mate assist device. The mate assist device includes an actuating arm movably mountable to the first connector housing, wherein the actuating arm includes at least one cam slot and the second connector housing includes at least one corresponding cam peg to engage the cam slot, such that upon actuating of the mate assist device the cam slot can draw the cam peg towards the first connector housing to move the second connector housing towards the first connector housing. The actuating arm is provided with at least one blocking wing, which arranged movable with respect to the actuating arm and prevents from actuating the mate assist device, when the second connector housing is not at least partially mated with the first connector housing.

14 Claims, 6 Drawing Sheets

CONNECTOR ARRANGEMENT WITH MATE-ASSIST DEVICE

1. FIELD OF THE INVENTION

The invention relates to a connector arrangement with a mate-assist device to facilitate the coupling of first and complementary second connector housings.

2. TECHNICAL BACKGROUND

In many technical fields electrical and electronic devices are more and more common, which require a suitable electrical connection. In the last 20 years, particular in the automotive industry a large range of new safety and comfort features were developed and introduced in passenger cars, many of those requiring a connection to the electronic control arrangements and/or the power supply of the vehicle. The increasing number of electrical and electronic devices to be connected led to the necessity of increasingly large connector arrangements to allow a connection of the resulting large number of signals lines. The increase of the electrical contacts to be mated upon each coupling of such a connector arrangement increases in turn the force necessary to close the connection between two complementary connectors. The large coupling forces necessary to mate the connectors poses a problem in modern assembly lines, in particular in situations, in which the location of the connectors to be coupled is difficult to access manually. However, the problem associated with mating is not only related to large connectors. Also the presence of sealing members or the application of particular materials result in increased mating forces. Still further, in awkward assembly conditions, as for example in a crowded engine compartment of a modern vehicle, the coupling of any kind of connector can pose a problem, even if only relatively small coupling forces have to be overcome. In order to facilitate the coupling of two connectors in the art so-called mate-assist devices were developed, which comprise for example a lever mechanism or a slider mechanism, which facilitate the coupling of two connector housings.

Document U.S. Pat. No. 6,422,882 B1 discloses a type of mate-assist device consisting in a U-shaped slider, which is arranged for a translatory movement on a first connector housing. The slider comprises two actuating arms being provided with a number of cam slots which interact with a number of cam pegs provided on the second connector housing. Upon actuating the mate assist device, i.e. upon pushing the U-shaped slider in a direction perpendicular to the mating direction of the two connector housings, the cam slots interact with the cam pegs, such that the second connector housing is pulled into the first connector housing. To prevent an unintentional actuating of the mate-assist device, i.e. the slider, the two arms of the slider are slightly bent towards each other and thus abut a stop member provided in the first connector housing. Upon insertion of the first connector housing into the second connector housing, the second connector is arranged between the arms of the slider and spreads the same apart in such a way, that the front faces of the arms are moved sideways past the stop members, so that the slider can be moved into its final position. This arrangement requires a U-shaped construction with two essentially parallel arms to function reliably. Further, this construction makes high demands with regard to production tolerances, since the whole length of the two parallel arms has to be bent in a very specific way for the slider to function properly. Still further, the actuating arms have to be relatively flexible, so that the second connector can spread them apart easily, which however is often undesirable, since the actuating arms should be as rigid as possible for their real purpose, i.e. the mate-assist function.

It is therefore an object of the present invention to improve the known connector arrangements with mate-assist devices and in particular to provide a new solution for a connector arrangement with mate-assist device which offers a particularly reliable construction. Still further, it is an object of the invention to provide a connector arrangement with mate-assist device, which is sufficiently rigid and at the same time secured against an unintended actuating, when no complementary connector housing is present in the arrangement. It is still further an object of the present invention to provide a connector arrangement with mate-assist device which is more robust than prior art systems. These and other objects, which become apparent upon reading the following description of a connector arrangement according to claim 1.

3. SUMMARY OF THE INVENTION

According to the invention a connector arrangement is provided comprising a first connector housing and a complementary, i.e. matable, second connector housing and a mate-assist device. The mate assist device comprises at least one actuating arm, which is moveably mountable on the first connector housing and which comprises at least one cam slot. The second connector housing comprises at least one corresponding cam peg to engage the cam slot, such that upon actuating the mate assist device, the cam slot can draw the cam peg towards the first connector housing to move the second connector housing towards the first connector housing. Thus, the mate assist device is adapted to interact with the first and second connector housings, so that upon actuation of the mate-assist device the actuating arm can move the second connector housing towards the first connector housing. According to the invention, the actuating arm is further provided with at least one blocking wing, which is arranged so as to be deflected with respect to the actuating arm and so as to prevent an actuating of the mate assist device, when the second connector housing is not at least partially mated with the first connector housing. This is preferably achieved by means of some kind of stop member provided on the first connector housing interacting with the blocking wing, which stops and/or prevents a movement of the actuating arm in the actuating direction of the mate-assist device. By inserting the second connector housing into the first connector housing the movable blocking wing is bent out of engagement with the stop member, so that the actuating arm can be moved in the actuating direction and can thus draw the first connector housing into the second connector housing or vice versa.

In a preferred embodiment, the actuating arm is initially in a "first" or pre-assembly position mounted on the first connector housing. In this first position, the actuating arm is held by the blocking wing and prevented from a further movement in the actuating direction. In this first position it is possible to at least partially mate the second connector housing with the first connector housing. Thereby preferably the blocking wing is disengaged from for example a corresponding stop element provided on the first connector housing, so to that the actuating arm is free to be moved in the actuating direction, whereby the second connector housing is moved towards the first connector housing. In all the embodiments described herein, the mate-assist device preferably causes a full mating of first and second connector housing. However, in alternative embodiments it is also possible that the mate-assist device only causes a partial mating, for example to help overcome some kind of initial major mating force, so that the subsequent necessary full mating of the connector housings is for example performed manually or by means of some other kind of tool. The actuating device in all the embodiments according to the invention may for example be a slider of the kind of those disclosed in the prior art documents discussed in the preamble of this description, except that it comprises a particular blocking wing as above mentioned.

Preferably, the blocking wing forms part of the at least one cam slot.

In a further preferred embodiment, the actuating device comprises two parallel actuating arms connected by a common web to form a u-shaped structure, which u-shaped structure is adapted to at least partially receive the second connector housing therebetween in mated condition of first and second connector housing.

The blocking wing described herein is preferably less rigid than the actuating arm itself. In this way, the forces necessary to deflect or move the blocking wing out of its blocking position can be reduced and at the same time the actuating arm may be provided with a sufficient rigidity for its actuating purpose. For the same reasons, it is also conceivable and preferred, that the blocking wing has a reduced thickness in comparison with the actuating arm. In this way, the actuating arm and the blocking wing can be provided as one integral part and the blocking wing is still arranged movable with respect to the actuating arm itself. In yet a further preferred embodiment, only a portion of the blocking wing is provided with a reduced thickness in comparison with the actuating arm, to facilitate a bending or deflecting of the blocking wing with respect to the actuating arm. This portion with reduced thickness could be considered as a "hinge" member or "hinge" area. This portion may be a groove between the blocking wing and the remaining part of the actuating arm. The fact that a cam slot defines a portion of the blocking wing contour allows more flexibility of the blocking wing relatively to the remaining part of the actuating arm.

The present invention provides the advantage that upon partial insertion (or full insertion) of the second connector housing into the first connector housing, the actuating arm is not necessarily deflected by the second connector housing. Thus, only the relatively low forces to move or deflects the blocking wing have to be overcome instead of moving the whole actuating arm as it was necessary in the prior art. Thus, the present invention allows to optimize the properties of the elements of the mate-assist device, and to provide for example the actuating arm with a very rigid and robust construction, and the blocking wing with a—in comparison—weaker and/or more flexible construction. Since the blocking wing at the same time forms a part of the cam slot, e.g. since a part of a peripheral edge of the blocking wing forms a part of the at least one cam slot, a particularly compact construction can be achieved. Further, the slot may provide flexibility to the blocking wing with regard to the remaining part of the actuating arm. Still further, the present invention allows for example to manufacture the actuating arm from a different material than the blocking wing. Thus, as an alternative, the blocking wing is made from a different material than the actuating arm, and preferably from a less rigid material than the actuating arm. This kind of construction can be used with all the embodiments described herein.

The present invention is in particular suitable for mate-assist devices of the type comprising actuating members which are moved linear and perpendicular to the mating direction of the connector housings. Thus, in all the embodiments described herein, the actuating arm (or arms) are most preferably arranged movable perpendicular to the mating direction of first and second connector housings.

4. DESCRIPTION OF THE PREFERRED EMBODIMENTS

In the following the invention is described exemplarily with reference to the enclosed figures, in which FIG. 1A shows a schematic illustration of a mate-assist device in accordance with the invention;

Figure 1A:
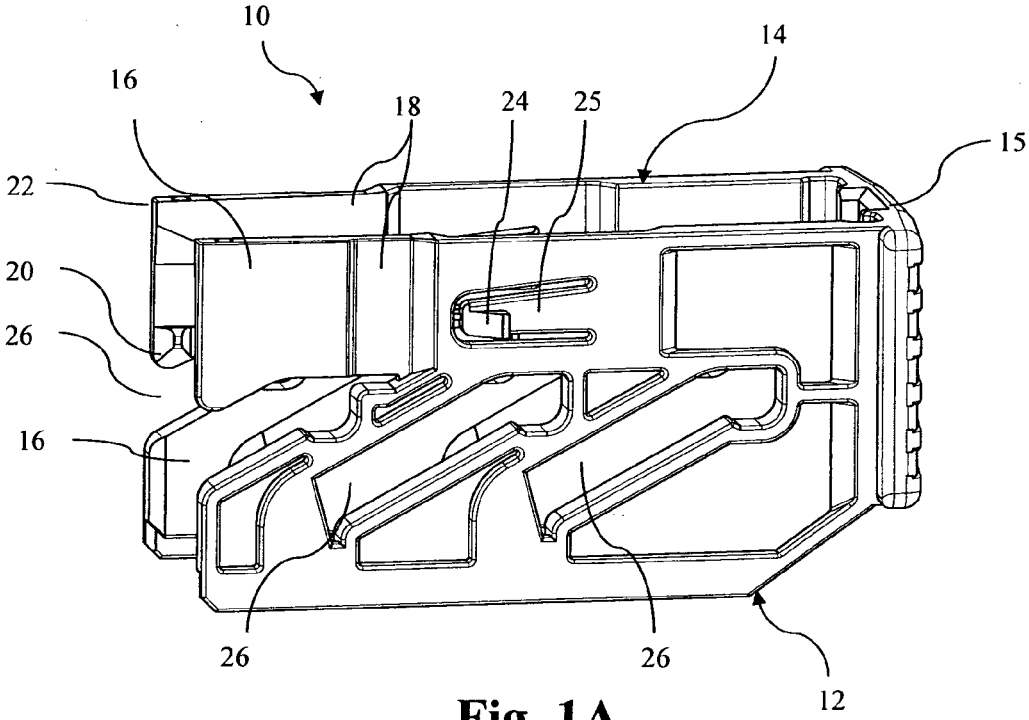
FIG. 1B shows the mate-assist device of FIG. 1A in a top view.
Figure 1B:
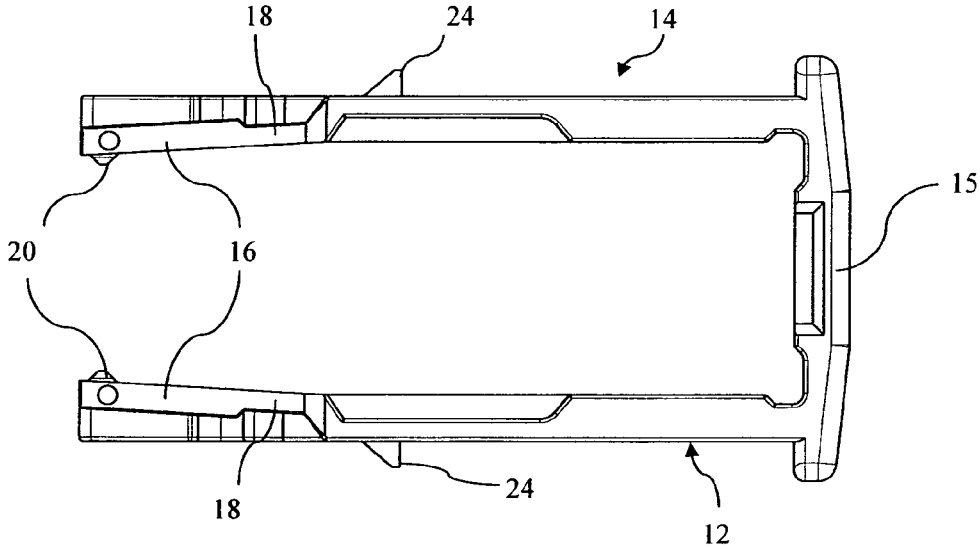

FIG. 1A shows a mate-assist device 10 in accordance with the present invention. The device comprises two parallel actuating arms 12 and 14, which are connected by a common beam or web 15, thereby forming a u-shaped structure, which u-shaped structure is adapted to at least partially receive the second connector housing between the arms and the web, in mated condition of first and second connector housings. It should be noted that the device 10 is symmetrical, i.e. the actuating arm 14 comprises exactly the same features as the actuating arm 12 visible in FIG. 1A. In the following, identical reference numbers will be used to describe identical features in both actuating arms 12 and 14. Each actuating arm is provided with a blocking wing 16, which is provided in a form of a tongue and which is movably and flexibly connected to the actuating arm by means of a hinge portion 18, which is less rigid than the actuating arm 12, 14. The blocking wing is provided with an actuating protrusion 20, which is adapted to interact with a second connector housing, as will be explained further below. As one can best see from FIG. 1B, the blocking wing 16 is of substantially a lesser thickness than the actuating arms 12, 14. As one can best derive from FIG. 1A, at least a part of a peripheral edge of the blocking wing 16 forms a part of the at least one cam slot. This edge corresponds to the downward peripheral edge on FIG. 1A (although it will be clear to the skilled person that the connector arrangement shown can be used in any spatial orientation and terms like "upwards" or "downwards" are merely used in connection with the specific arrangements shown in the figures to facilitate description thereof). By this specific arrangement it is possible to achieve a particular compact construction which is nevertheless rigid enough, since the forces acting between the cam peg and the cam slot are directed mostly parallel to the plane of the blocking wing 16, so that the reduced thickness thereof does not negatively affect the cam slot function.

The actuating arms further comprise protrusions 24 arranged on flexible arms 25. The protrusions 24 serve to interact with a corresponding guide groove or slot provided on the first connector housing to prevent that the mating devices is unintentionally removed from the connector housing. The actuating arms further comprise three cam-slots 26, each adapted to interact with corresponding cam-pegs as will be explained in the following.

Figure 2:
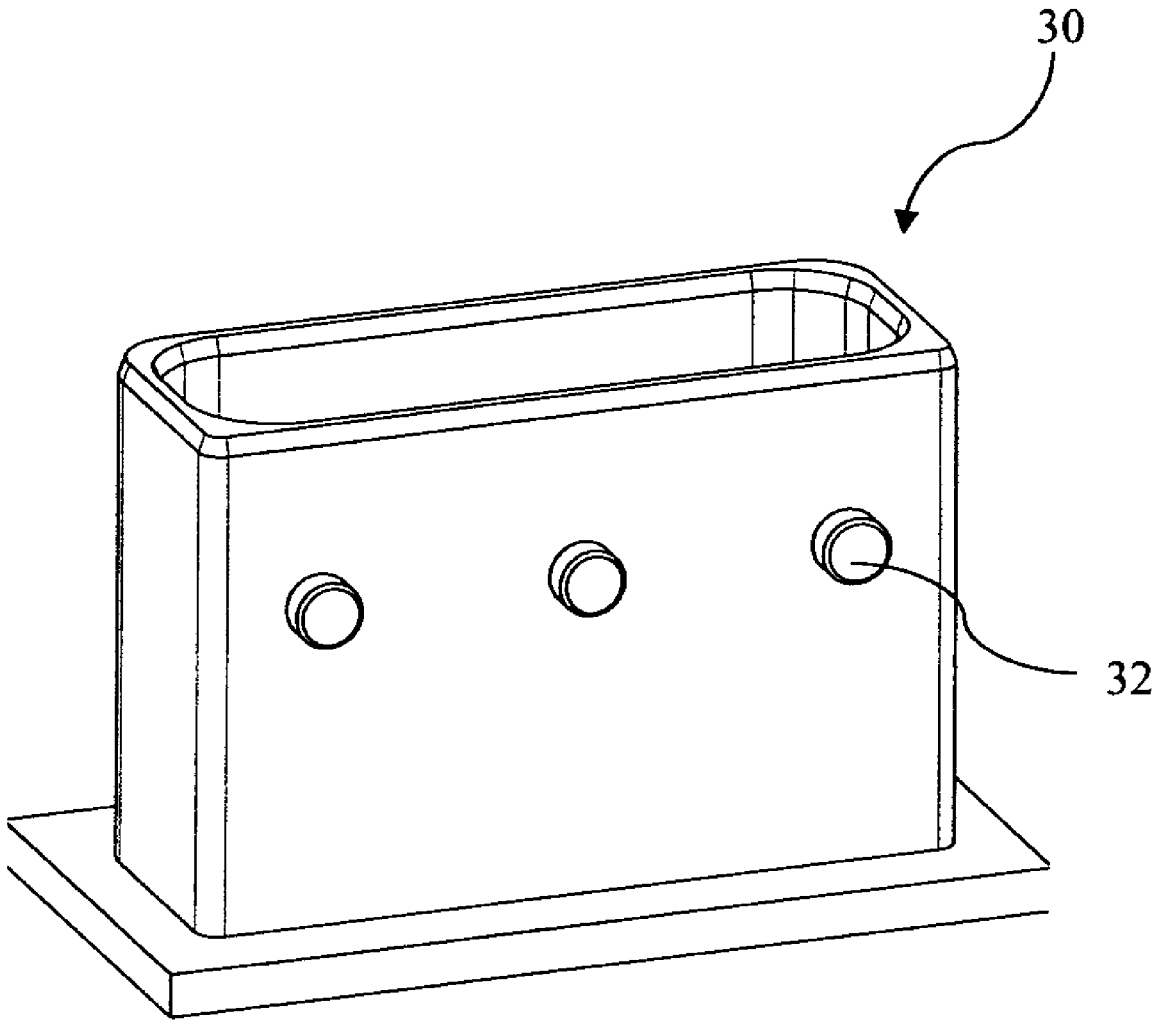
FIG. 2 shows a second connector housing suitable for use with the present invention.

FIG. 2 is a schematic illustration of a second connector housing adapted to be used with the present invention. The second connector housing 30 comprises three cam-pegs 32 adapted to interact with the cam-slots 26 provided on the mate-assist device 10. The second connector housing 30 is constructed to be at least partially inserted into the first connector housing, as will be shown below with reference to FIG. 4A to 4C.

Figure 3A:
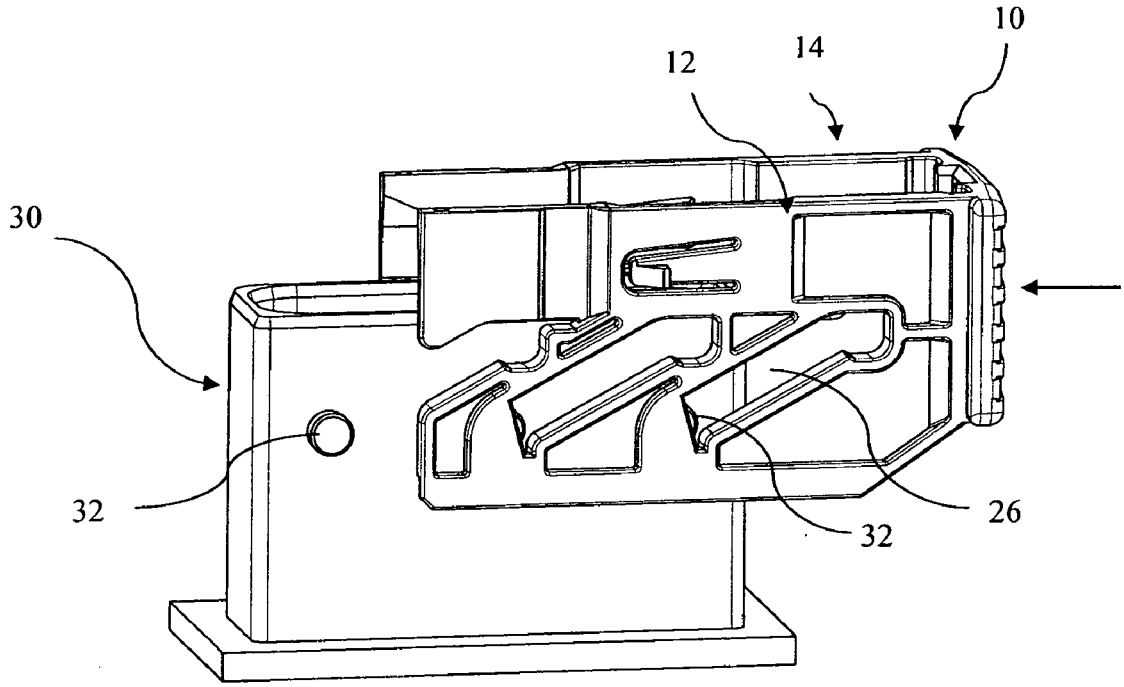
FIG. 3A is a schematic illustration showing the function of the mate-assist device of FIGS. 1A and B.
Figure 3B:
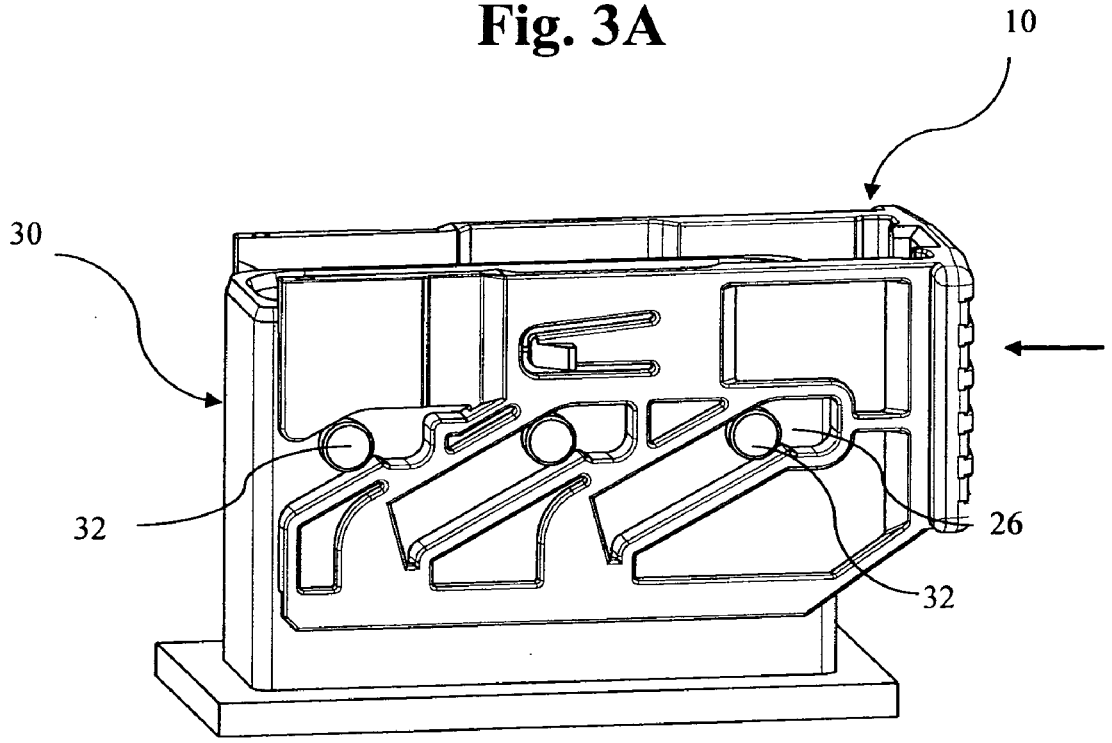
FIG. 3B shows the same arrangement as FIG. 3A, when the mate-assist device is further moved into the actuating direction.

FIGS. 3A and 3B illustrate the function of the mate-assist device 10 and the cam-slots 26 provided therein. It should be noted that the illustrations of FIGS. 3A and 3B only serve to facilitate the explanations of the operation of the mate-assist device. Into practice, the mate-assist device 10 is mounted on the first connector housing (FIG. 4A to 4C), which first connector housing is not shown in FIG. 3A to 3B to facilitate understanding. As one can see from the FIG. 3A, the cam-pegs 32 are arranged at the beginning of cam-slots 26. When the device 10 is moved in the actuating direction, i.e. to the left in FIGS. 3A and 3B, the cam-pegs 32 interact with the cam-slots 26. As shown on FIG. 3B, as the device 10 goes from the right to left side, the device 10 and the second connector housing 30 come into further engagement and brought one towards the other in the vertical direction.

Figure 4A:
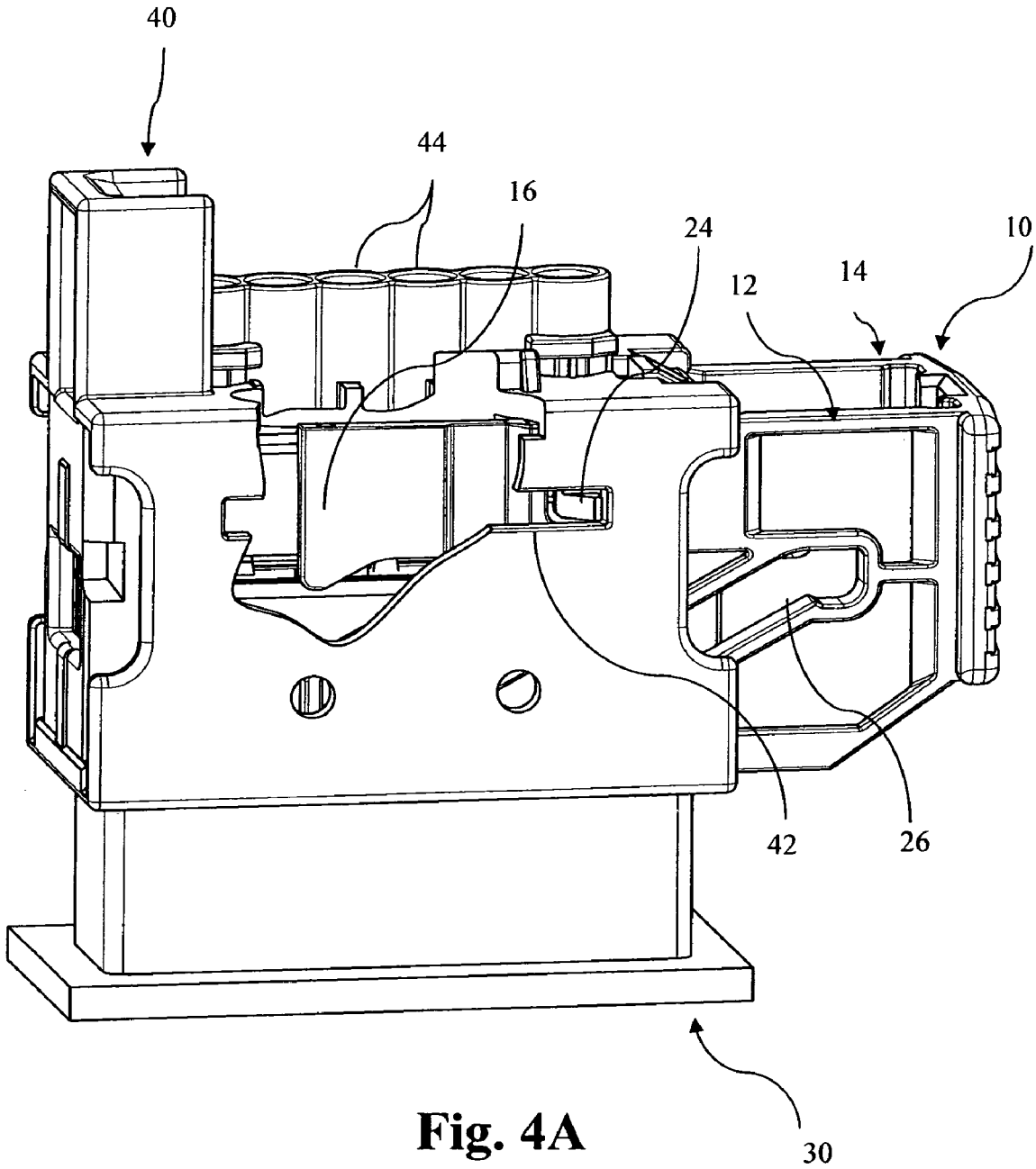
FIG. 4A is a partially cut-view showing a connector arrangement in accordance with the present invention.
Figure 4B:
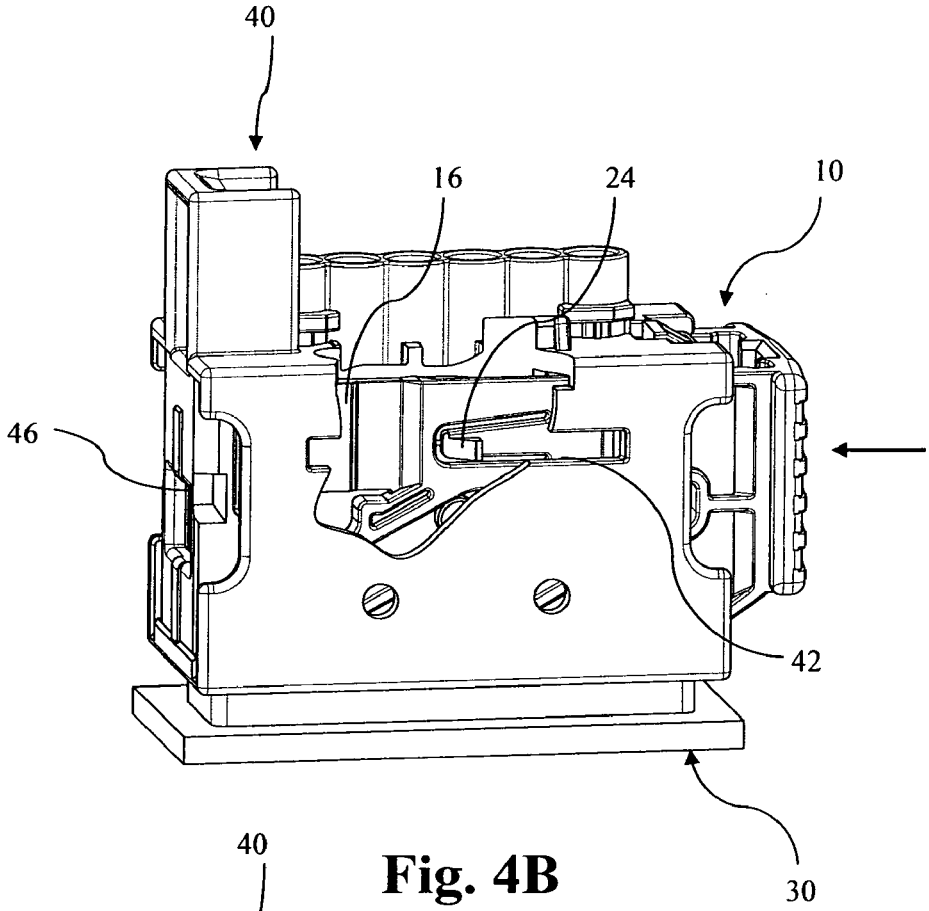
FIGS. 4B and 4C show the same arrangement as FIG. 4A, when the mate-assist device is further moved into the actuating direction.
Figure 4C:
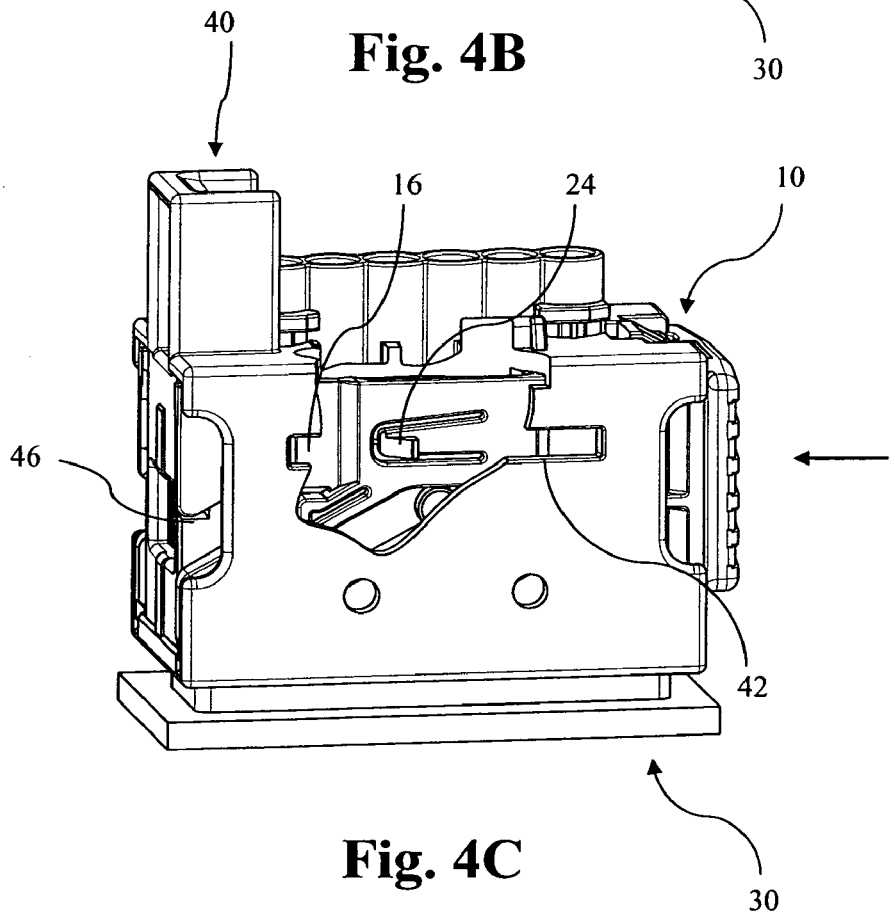

FIG. 4A shows the connector arrangement according to the present invention in assembled condition. The first connector housing 40 is shown in a partially cut-view, so that the blocking wing 16 of mate-assist device 10 is visible in FIG. 4A. In the arrangement shown, the mate-assist device 10 is preassembled on the first connector housing 40 before the second connector housing 30 is partially inserted into the first connector housing 40. The first connector housing 40 is provided with a groove or slot 42 interacting with the protrusion 24 provided on the actuating arms of the device 10. The reference number 44 denotes several channels for the insertion of the electrical signal lines to be connected by the first and second connector housing. It should be noted that the mating or coupling direction is vertical in the arrangement shown in FIG. 4A. Obviously, the connector arrangement maybe operated in any desired spatial orientation. The actuating or working direction of mate-assist device 10 is a translatory movement perpendicular to the mating or coupling direction of the two connector housings. In the arrangement shown in FIG. 4A, the device 10 is moved to the left in the Figures, guided by the shape of the first connector housing, which comprises slot-like openings for the reception of the arms 12, 14, such that the device 10—and thus the actuating arms 12, 14—are moved linearly perpendicular to the mating direction. As the skilled person will recognize from the views shown in FIGS. 4A and 4B, by the linearly guided movement of device 10, the second connector housing 30 will be "drawn" upwards in FIG. 4A into first connector housing 10 by means of the interaction of cam-pegs 32 and cam grooves 26. Thereby, the mate-assist device 10 facilitates the mating of first and second connector housing. The movement of device 10 in the actuating direction and the movement of second connector housing 30 into first connector housing 40 are illustrated by FIGS. 4A, 4B and 4C. The actuating arms 12 and 14 receive the second connector housing 30 therebetween in the mated condition shown in FIG. 4C.

The connector housing 40 further comprises latching recesses 46 into which the protrusions 20 snap upon complete insertion of the mate-assist device 10 into the housing. Due to the latching recesses 46 an audible "click" sound occurs upon complete insertion of mate-assist device into housing, giving the operator an audible feedback of the mating. This further improves the security of the connector arrangement.

Figure 5A:
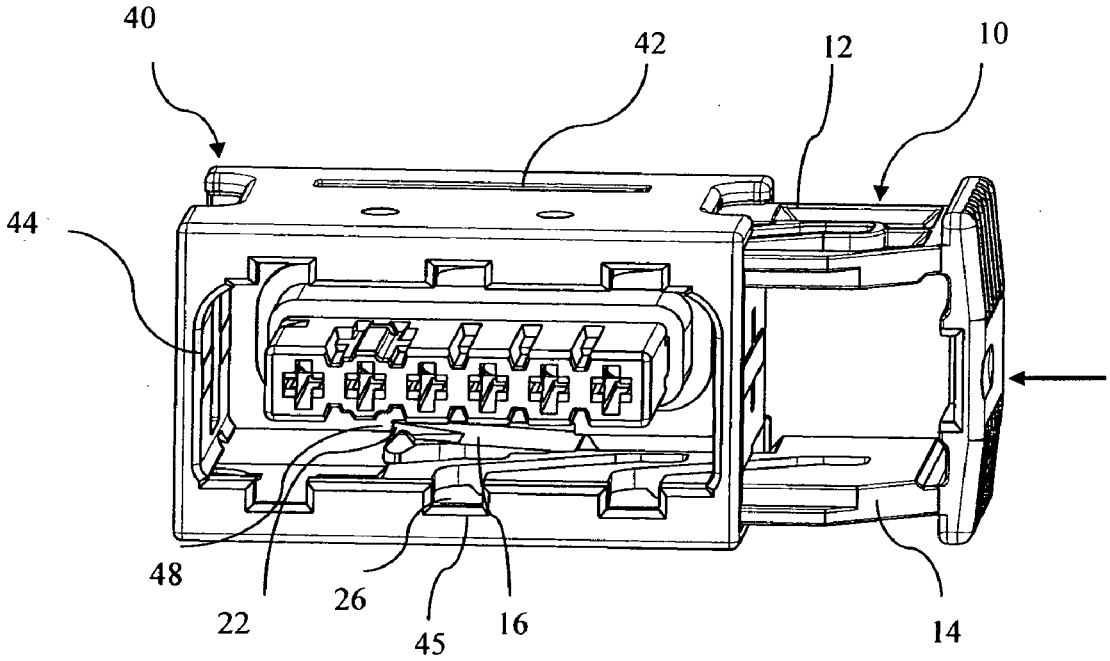
FIG. 5A is a schematic illustration showing how the mate-assist device is mounted to a first connector housing, when the mate-assist device is in its locked or pre-latch condition.
Figure 5B:
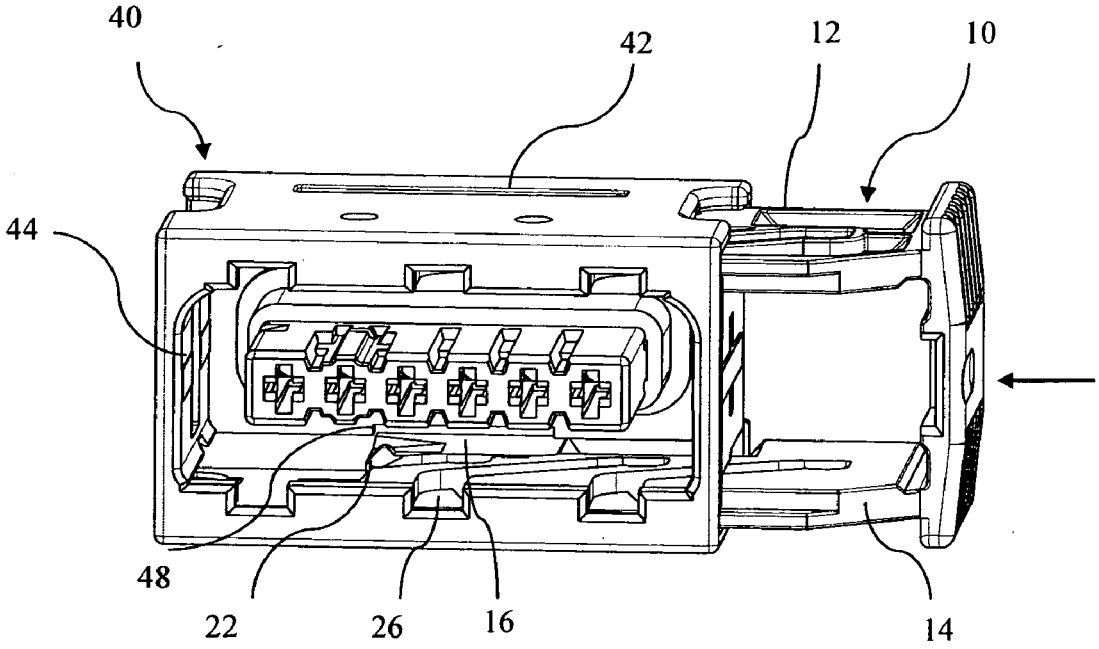
FIG. 5B shows the same arrangement as FIG. 5A, when the blocking wing of the actuating arm is released from a stop element provided on the first connector housing.

FIGS. 5A and 5B show mate-assist device 10 mounted on first connector housing 40 with the second connector housing 30 removed from the first connector for a better understanding. In the view of FIGS. 5A and 5B, the first connector housing 40 is shown from the bottom side and one can clearly see the opening 44, which is shaped to accommodate the second connector housing 30 shown in FIG. 2. From FIG. 5A one can also see, how the cam slots 26 are in alignment with notches 45 to accommodate the cam pegs 32 upon insertion of second connector housing into first connector housing. From FIG. 5A one can further derive how a stop face 22 provided at the free end of the blocking wing abuts a stop element 48 provided on the first connector housing. Thereby, in the position shown in FIG. 5A, the mate-assist device 10 is prevented from being moved in the actuating direction into first connector housing 40.

One major advantage of the present invention is that the mate-assist device can be mounted from both sides of housing 10, i.e. in a mirrored arrangement to the one shown in the figures. Thus, preferably, in all the embodiments shown herein housing and mate-assist device are adapted such that the mate-assist device can be mounted to the housing from two opposite sides.

FIG. 5B shows the arrangement of FIG. 5A, when the blocking wing is bent outwardly due to the partial insertion of second connector housing into opening 44 of first connector housing. As mentioned above, second connector housing 30 is not shown in the view of FIG. 5B, to allow the description of the function of blocking wing 16. As one can see from FIG. 5B, the stop face 22 of the blocking wing 16 is no longer in abutment with stop element 48 of first connector housing 40. In the position shown in FIG. 5B, the mate assist device 10 can be moved further into connector housing 40, i.e. in the actuating direction. One can further see from FIGS. 5A and 5B that upon insertion of the second connector housing 30, only the blocking wing is bent out of the way, whereas the actuating arms 12 and 14 are not moved by the second connector housing. Thereby, upon (partial) insertion of second housing 30 into first housing 40, the operator only has to overcome the relatively low resistance offered by blocking wing 16, which thanks to the hinge portion 18 is relatively low, compared to the robust and very rigid actuating arms 12 and 14. Thus, in the connector arrangement shown in the Figures, the blocking wing is arranged movable with respect to the actuating arm and prevents an actuating of the mate-assist device 10, when the second connector housing 30 is not at least partially mated with the first connector housing 40.

The invention claimed is:

1. Connector arrangement, comprising:

a first connector housing and a complementary second connector housing;

a mate assist device, comprising at least one actuating arm movably mountable to the first connector housing, wherein the actuating arm comprises at least one cam slot and the second connector housing comprises at least one corresponding cam nose to engage the cam slot, such that upon actuating of the mate assist device the cam slot can draw the cam nose towards the first connector housing to move the second connector housing towards the first connector housing;

wherein the actuating arm is provided with at least one blocking wing, which forms part of the at least one cam slot and which wing is arranged movable with respect to the actuating arm and prevents an actuating of the mate assist device, when the second connector housing is not at least partially mated with the first connector housing, characterized in that the blocking wing has a reduced thickness in comparison with the actuating arm or in that at least one portion of the blocking wing is provided with a reduced thickness in comparison with the actuating arm to facilitate a bending of the blocking wing with respect to the actuating arm.

2. Connector arrangement according to claim 1, wherein the blocking wing abuts a stop element provided on the first connector housing and wherein the blocking wing is released from the stop element, when the second connector housing is at least partially mated with the first connector housing.

3. Connector arrangement according to claim 1, wherein the actuating arm is mounted movable to the first connector housing such that it can be moved from a first position, in which the second connector housing can partially mate with the first connector housing, to a second position, in which the second connector housing is fully mated with the first connector housing.

4. Connector arrangement according to claim 1, wherein the actuating device comprises two parallel actuating arms connected by a common web to form a u-shaped structure, which u-shaped structure is adapted to at least partially receive the second connector housing therebetween in mated condition of first and second connector housing.

5. Connector arrangement according to claim 1, wherein the actuating arm comprises at least one further cam slot, which is not formed by the blocking wing.

6. Connector arrangement according to claim 1, wherein the blocking wing abuts a stop element provided on the first connector housing when the second connector housing is not at least partially mated with the first connector housing and wherein the blocking wing is deflected from the stop element by the second connector housing upon partial insertion of the second connector housing in the first connector housing.

7. Connector arrangement according to claim 1, wherein the blocking wing is less rigid than the actuating arm.

8. Connector arrangement according to claim 1, wherein at least a part of a peripheral edge of the blocking wing forms part of the at least one cam slot.

9. Connector arrangement according to claim 1, wherein the blocking wing is provided in form of a tongue, whereby one end of the tongue is connected with the actuating arm and the free end of the tongue abuts a stop element provided on the first connector housing, when the second connector housing is not at least partially mated with the first connector housing.

10. Connector arrangement according to claim 1, wherein the blocking wing is connected to the actuating arm by means of a hinge portion, which is of lesser rigidity than the actuating arm, to facilitate the movement of the blocking wing with respect to the actuating arm.

11. Connector arrangement according to claim 1, wherein the blocking wing is provided with an actuating protrusion, which is adapted to interact with the second connector housing upon partial insertion of the first connector housing in the second connector housing or vice versa to bent the blocking wing to a release position, in which the mate assist device can be actuated.

12. Connector arrangement according to claim 1, wherein the actuating arm comprises at least one protrusion which engages a corresponding guide groove provided on the first connector housing to guide the movement of the actuating arm, which guide groove is adapted to allow a linear movement of the actuating arm perpendicular to the mating direction of first and second connector housing.

13. Connector arrangement according to claim 1, wherein upon partial insertion of second connector housing into first connector housing the actuating arm is not deflected by the second connector housing.

14. Connector arrangement according to claim 1, wherein the blocking wing is provided with an actuating protrusion, which is adapted to interact with the second connector housing upon partial insertion of the first connector housing in the second connector housing or vice versa to bent the blocking wing to a release position, in which the mate assist device can be actuated and the first connector housing is provided with at least one latching recess adapted to receive the actuating protrusion when the mate-assist device is fully inserted and which recess provides an audible feedback when the actuating protrusion moves into the recess.

* * * * *